United States Patent [19]

Musto et al.

[11] Patent Number: 4,464,999

[45] Date of Patent: Aug. 14, 1984

[54] DIRECT PULVERIZED FUEL FIRED SYSTEM

[75] Inventors: Richard L. Musto, Homewood, Ill.; Norichika Kai, San Paulo, Brazil

[73] Assignee: Combustion Engineering, Inc., Windsor, Conn.

[21] Appl. No.: 442,558

[22] Filed: Nov. 18, 1982

[51] Int. Cl.[3] ..... F23K 1/00

[52] U.S. Cl. ..... 110/106; 110/263; 209/144

[58] Field of Search ..... 110/106, 222, 232, 263; 209/144; 241/56

[56] References Cited

U.S. PATENT DOCUMENTS

| | | | |
|---|---|---|---|
| 1,562,411 | 11/1925 | Caracristi et al. | 110/106 |
| 1,627,766 | 5/1927 | Bergman | 110/106 |
| 1,628,609 | 5/1927 | Newhouse | 110/106 |
| 2,716,002 | 8/1955 | Craig | 110/106 |
| 2,849,968 | 9/1958 | Krug | 110/106 |
| 2,968,401 | 1/1961 | Sheldon | 209/144 |
| 3,043,525 | 7/1962 | Gilbert | 110/106 |
| 4,171,960 | 10/1979 | Jarvenpaa | 209/144 |
| 4,342,897 | 8/1982 | Murai et al. | 209/144 |
| 4,387,654 | 6/1983 | Binasik et al. | 110/106 |

*Primary Examiner*—Henry C. Yuen

*Attorney, Agent, or Firm*—Arthur E. Fournier, Jr.

[57] ABSTRACT

A direct fired system (10, 10') includes pulverizer means (14, 24) classifier means (12, 26, 28, 48, 76), burner means (16, 16') as well as a defined fluid flow path that serves to interconnect the pulverizer means (14, 24) and the classifier means (12, 26, 28, 48, 76) in fluid flow relation with the burner means (16, 16'). In accord with the mode of operation thereof, at the classifier means (12, 26, 28, 48, 76) a separation is had of the stream of the gaseous medium such that a portion of the gaseous medium is recirculated along with the oversize solid fuel particles back to the pulverizer means (14, 24) while the remainder of the gaseous medium is operative to convey the solid fuel particles that are of the desired size from the classifier means (12, 26, 28, 48, 76) to the burner means (16, 16') for burning, i.e., firing, in the latter.

2 Claims, 5 Drawing Figures

DIRECT PULVERIZED FUEL FIRED SYSTEM

BACKGROUND OF THE INVENTION

This invention relates to pulverizing and firing systems for solid fuels, and in particular to direct fired systems operative for purposes of effecting the pulverization and subsequent firing of solid fuels in any form of structure that embodies a suitable type of combustion chamber, e.g., boilers, kilns, furnaces, air heaters, etc.

There are three basic types of solid fuel pulverizer firing systems in use today. These are the direct-fired system, the semi-direct fired system and the bin storage system. The simplest and most commonly used of these three systems is the direct-fired system. The nature of this latter system is such that solid fuel, e.g., wet coal, is fed in a suitable manner along with hot gases to a pulverizer. The solid fuel is simultaneously ground and dried within the pulverizer. The drying of the solid fuel is effected by the hot gases as the latter sweep through the pulverizer. The pulverizer that is utilized to accomplish the above may take the form of a hammermill, a ring-roll mill or a ball mill. As the hot gases sweep through the pulverizer they are cooled and humidified by means of the evaporation of the moisture contained in the solid fuel. Normally, a fan is utilized for purposes of removing the hot gases and the entrained fine solid fuel particles from the pulverizer. Moreover, usually this fan is located on the discharge side of the pulverizer and is operative to effect the delivery of the mixture of hot gases and entrained fine solid fuel particles to a burner. Finally, note is taken here of the fact that some pulverizers are provided with an internal classification system which rejects the oversize solid fuel particles and returns them to the grinding chamber of the pulverizer for further pulverizing. While, there are other pulverizers that are provided with external classifiers that reject the oversize and incompletely dried solid fuel particles and cause them to be returned to the wet feed inlet of the pulverizer.

The main advantages of the direct-fired system are simplicity, low cost and maximum safety. The potentially hazardous fine solid fuel particles go directly to the burner at high velocity, and thus are not given the opportunity to collect and possibly ignite spontaneously. Accordingly, the direct-fired system can be operated at the maximum temperatures that safety will allow. Further, in those instances wherein the pulverization of the solid fuel is effected by means of hammermills or ring-roll mills there is very little solid fuel present in the system at any given time. Therefore, should a fire occur in the system, it will be of relatively small size and as such is capable of being readily extinguished.

However, there is one major disadvantage associated with the employment of a direct-fired system. This consists of the fact that all of the hot gas, e.g., air, that is required for purposes of drying the solid fuel particles plus the air that infiltrates the pulverizer becomes primary air for the burner. Therefore, in those instances wherein the solid fuel particles are very wet more air is required for drying. Accordingly, the quantity of primary air thus forms a large percentage of the air which is required to support combustion. Further, in the case of pulverizers that take the form of hammermills and ring-roll mills, the amount of air that is required to flow therethrough in order for the pulverizer to operate at maximum capacity may be in excess of that required to dry the solid fuel particles. Lastly, the air which leaves the pulverizer is usually low in temperature and high in moisture. Unfortunately, though, the thermal efficiency of the burner is adversely affected when air that is low in temperature and/or high in moisture is utilized to support combustion in the burner.

Thus, to recapitulate, the mode of operation of a direct-fired system is such that all of the hot gas which is required to dry the solid fuel particles as well as that which is required to sweep the pulverizer for purposes of effecting the transport therethrough of the solid fuel particles operates also to effect the conveyance of the pulverized solid fuel to the combustion chamber of the burner wherein the solid fuel is fired. Moreover, since the conveying medium is usually air, the latter becomes part of the combustion air that is required to effect the burning, i.e., firing, of the solid fuel. Unfortunately, the hot gas, e.g., air, required to satisfy the drying, grinding, classifying requirements imposed thereupon by virtue of the nature of the operation of the pulverizer constitutes a relatively large quantity thereof and also is at a relatively low temperature. Both of these factors render the hot gas that flows through the pulverizer undesirable for use as combustion air in the burner. On the other hand, in most applications wherein a pulverizer is employed in conjunction with a burner to supply pulverized solid fuel thereto, there is an adequate amount of hot combustion air available, which has been recuperated from the exhaust gases of the system through the use of heat exchangers. Consequently, by utilizing the hot combustion air that has been recuperated from the exhaust gases of the system in lieu of the hot air that flows through the pulverizer, it is possible to improve the thermal efficiencies of the system and concomitantly thereby reduce the fuel consumption requirements thereof.

Turning next to a consideration of the second of the three types of firing systems referred to hereinbefore, i.e., that of the semi-direct fired system, the development thereof was occasioned principally by the desire to overcome the disadvantage of the direct-fired system which has been discussed above, while yet providing a system that would maintain the desirable safety and low cost features which are characteristic of a direct-fired system. Thus, in accord with the mode of operation of the aforesaid semi-direct fired system, the mixture of pulverized solid fuel particles and spent drying gases is conveyed through the action of a system fan to a cyclone collector whereat a separation thereof is effected. Namely, a portion of the spent drying gases is circulated from the cyclone collector back to the pulverizer whereat the recirculated spent drying gases are reheated by virtue of being mixed with high temperature fresh hot gases with which the pulverizer is being fed. The remainder of the spent drying gases that are received at the cyclone collector are vented. Desirably, the portion of the spent drying gases that is vented equals the weight of the fresh hot gases fed to the pulverizer, the amount of air that leaks into the pulverizer, and the water that is evaporated. Generally, under most conditions, the quantity of spent drying gases that is vented is considerably less than the total quantity that is required to flow through the pulverizer for purposes of effecting the efficient operation of the latter. Continuing, the quantity of spent drying gases that is vented is than directed to the solids discharge area of the cyclone collector whereat the vented gases pick up the pulverized solid fuel particles and function to convey the latter in the form of a mixture of pulverized solid fuel particles and vented gases having a very high fuel to air ratio to the combustion chamber of the burner. The conveying vented gases, e.g., air, then become a very small percentage of the total amount of combustion air that is required to effect the firing of the pulverized solid fuel particles in the burner. The additional air necessary to support combustion is then introduced into the burner from the recuperator. That is, this additional air constitutes hot air which has been recuperated from the system's exhaust gases.

Finally, the remaining one of the three types of firing systems that has yet to be discussed herein is that of the bin storage system. In accord therewith, the hot gas flow circuit associated with the functioning of the pulverizer is totally divorced of the hot gas flow which the burner receives. More specifically, the mode of operation of the bin storage system is such that the mixture of pulverized solid fuel particles and spent drying gases is conveyed to a cyclone collector whereat the pulverized fuel particles are discharged into a storage bin and the drying gases are vented to a secondary collector and thence to the atmosphere. As required, quantities of pulverized solid fuel particles are removed from the storage bin along with a relatively small quantity of conveying air thereby maximizing the amount of heated recuperated air which can be employed as combustion air for purposes of firing the pulverized solid fuel particles in the burner. Accordingly, the bin storage system provides the highest thermal efficiency of the three firing systems that have been discussed herein, i.e., the direct-fired system, the semi-direct fired system and the bin storage system.

Insofar as a comparison of the three above-described firing systems is concerned, the increase in thermal efficiency which is achieved with the semi-direct fired system and the bin storage system is obtainable only at the expense of providing a system that has less desirable operating features and which is more complex. By way of exemplification in this regard, note is taken of the fact that pulverized solid fuel particles can pose a potential hazard insofar as the handling and storage thereof is concerned. Moreover, pulverized solid fuel particles are known to be susceptible to igniting spontaneously.

On the other hand, the main advantages of the direct-fired system are its simplicity, low cost, and safe mode of operation. These advantages stem principally from the fact that in accord with the mode of operation of the direct-fired system the potentially hazardous pulverized solid fuel particles are conveyed directly to the combustion chamber of the burner at relatively high velocities whereat they are fired. Consequently, problems associated with the handling and storage of the pulverized fuel particles are avoided. Likewise, with such a mode of operation there is no opportunity for the pulverized fuel particles to collect and subsequently spontaneously ignite.

As regards the semi-direct fired system, the latter has a less desirable mode of operation when compared to the aforereferenced direct-fired system in that the pulverized solid fuel particles upon entering the cyclone collector pass through both limits of the explosive range thereof as the hot gases are being separated therefrom. Therefore, the pulverized fuel particles become very sensitive to temperature and are susceptible to being ignited upon being exposed to system vent temperatures of a relatively high nature. Additionally, in the semi-direct fired system the cyclone collector is usually operated at a relatively high negative pressure whereas the line located therebeneath through which the pulverized solid fuel particles upon being discharged from the cyclone collector are conveyed to the combustor is usually at a very high positive pressure. Consequently, the value which is utilized to discharge the pulverized fuel particles from the cyclone collector into the aforementioned conveying line operates at an extremely high differential pressure which produces rapid wearing of the valve. This wearing of the valve in turn gives rise to the occurrence of subsequent leakage of the conveying gas from the line into the cyclone collector. Furthermore, such leakage has an adverse effect on the operating efficiency of the cyclone collector and also can occasion a condition wherein a mixture of solid fuel particles and hot gases, which is of an explosive nature, is caused to be recycled back to the pulverizer.

When compared to the other two forms of firing systems and most particularly to the direct-fired system, the bin storage system is disadvantageously characterized in at least two significant respects. First, by virtue of the nature of the mode of operation of the bin storage system there exists a requirement that pulverized fuel particles be stored in a storage bin. It is a known fact, however, that pulverized solid fuel particles when stored can spontaneously ignite. Moreover, should such spontaneous ignition of the particles occur, the extinguishment and the removal of the ignited particles from the storage bin could be expected to present a problem. Thus, in an effort to minimize the extent of this problem, storage bins for storing such pulverized fuel particles have heretofore been sealed and pressurized with inert gas. Unfortunately, however, to do this is rather costly. With further reference to the matter of the storage bin, ensuring that pulverized fuel particles are discharged therefrom at a uniform controlled rate can necessitate the employment in cooperative association with the storage bin of some type of means which is undesirably characterized both in terms of its complex construction and the fact that it is costly to provide. By way of exemplification in this regard, reference is had here to the fact that some forms of pulverized solid fuels such as pulverized coal have flow characteristics that are much like those of water whereas other forms of pulverized solid fuels such as pulverized bark and wood have a tendency to collect and effect a bridging of the discharge outlet of the storage bin thereby requiring the utilization of a further means that has the operative capability to negate this tendency of the pulverized fuel to collect and effect a bridging of the discharge outlet of the storage bin.

The second notable disadvantage of the bin storage system involves the gaseous discharge that occurs therefrom to the atmosphere. Namely, since cyclone collectors are known to be less than one hundred percent efficient in removing all of the particulate matter from the mixture of solid fuel particles and conveying gases that is received thereby, particulate matter is emitted along with the gas that is exhausted therefrom to the atmosphere. Further, it is possible that the extent of such particulate matter emission may be such as to run afoul to the air pollution requirements that are in effect in the jurisdiction in which the bin storage system is being employed. In addition, in those instances wherein a high pressure drop wet scrubber is utilized for purposes of effecting the removal of particulate matter from the gas stream, a further problem may be posed. More specifically, the nature of the mode of operation of a high pressure drop wet scrubber is such that relatively large quantities of water are required to accomplish the removal of the particulate matter to the extent desired. However, the need for such large quantities of water creates a disposal problem of its own since the water effluent from the scrubber may contain up to one to two percent of pulverized solid fuel particles. Usually, these solid fuel particles are required to be removed from the water effluent before the latter can be discharged into a local sewage system.

Accordingly, the type of secondary collector which is most commonly used with a bin storage system is that of a cloth bag dust collector. The latter, which is often referred to as a "baghouse", operates to effectively recover the particulate matter which is contained in the gases that are to be vented from the system to the atmosphere, as well as to effect the return of the recovered particulate matter to a suitable location. However, there are hazards associated with the use of a cloth bag dust collector to recover particulate matter from vent gases that are at relatively high temperatures. Namely, the particulate matter which enters the dust collector is of an extremely fine nature and thus can very easily spontaneously ignite if the particulate matter is not kept in a constant state of motion. Small upward excursions in the temperature of the gases that contain the particulate matter, which is sought to be recovered through the use of the dust collector, can be sufficient to cause the particulate matter to spontaneously ignite.

A need has thus been evidenced for a new and improved firing system that would be advantageously characterized by the fact that the mode of operation thereof enables a more desirable fuel/air ratio to be established at the burner, while yet providing a firing system which retains the advantages of a direct-fired system insofar as simplicity, low cost and safety are concerned. More specifically, such a new and improved firing system has been sought wherein the more desirable fuel/air ratio that is established thereby at the burner is accomplished as a consequence of causing the recirculation back to the pulverizer of a portion of the gases leaving the classifier.

It is, therefore, an object of the present invention to provide a new and improved form of firing system of the type that is operative for purposes of effecting the pulverization of solid fuels followed by the firing thereof.

It is another object of the present invention to provide such a firing system which is in the nature of a direct fired system.

It is still another object of the present invention to provide such a direct fired system which possesses the advantages of a direct-fired system insofar as simplicity, low cost and safety are concerned.

A further object of the present invention is to provide such a direct fired system which is further advantageously characterized by the fact that in accord with the mode of operation thereof a more desirable fuel/air ratio is established at the burner.

A still further object of the present invention is to provide such a direct fired system wherein the establishment of a more desirable fuel/air ratio at the burner is accomplished as a consequence of causing the recirculation back to the pulverizer of a portion of the gases that exit from the classifier and without requiring the use within the system of a cyclone collector or a discharge valve.

SUMMARY OF THE INVENTION

In accordance with the present invention there is provided a new and improved form of direct fired system operative for purposes of effecting the pulverization and firing of solid fuels. The subject system includes pulverizer means, classifier means, burner means as well as a predetermined fluid flow path that functions to interconnect the pulverizer means and the classifier means in fluid flow relation with the burner means. Further, the pulverizer means is of the type that is either equipped with an integral classifier of the double cone type or has an external classifier of the aforesaid type cooperatively associated therewith. Both the integral classifier and the external classifier have essentially the same mode of operation; namely, both types of classifier are operative to reject oversize solid fuel particles, which do not meet predetermined specifications regarding fineness, from the mixture of gas and pulverized particles flowing from the pulverizer. The rejection of the oversize particles is accomplished in known fashion. The classifier also functions to return the rejected oversize particles back to the pulverizer means for the further grinding thereof. In accord with one embodiment of the invention, a material handling fan is provided at that outlet of the classifier through which trailings normally leave the classifier. The aforesaid material handling fan is suitably employed such as to be operative to effect through the action thereof not only a return to the pulverizer of the oversize particles discharged from the classifier for additional grinding, but also a return of up to fifty percent of the gases being exhausted from the classifier, thereby reducing the quantity of gas flow from the classifier to the burner by approximately fifty percent. In accord with a second embodiment of the invention, the classifier is provided with a dust handling fan and a receiver hood located centrally of the cone of the classifier. The dust handling fan and receiver hood are intended to be operative for purposes of effecting the removal of up to fifty percent of the gases circulatng to the classifier and returning the removed gases back to the pulverizer such that the quantity of gases that remain to be transported to the burner are reduced by up to fifty percent. In accord with yet another embodiment of the invention, a dust handling fan is positioned at the outlet of the classifier where it is operative to effect the removal from the classifier and the recirculation to the pulverizer of up to fifty percent of the gases being exhausted from the classifier whereupon the flow of gases from the classifier to the burner is reduced by up to fifty percent.

DESCRIPTION OF A PREFERRED EMBODIMENT

Figure 1:
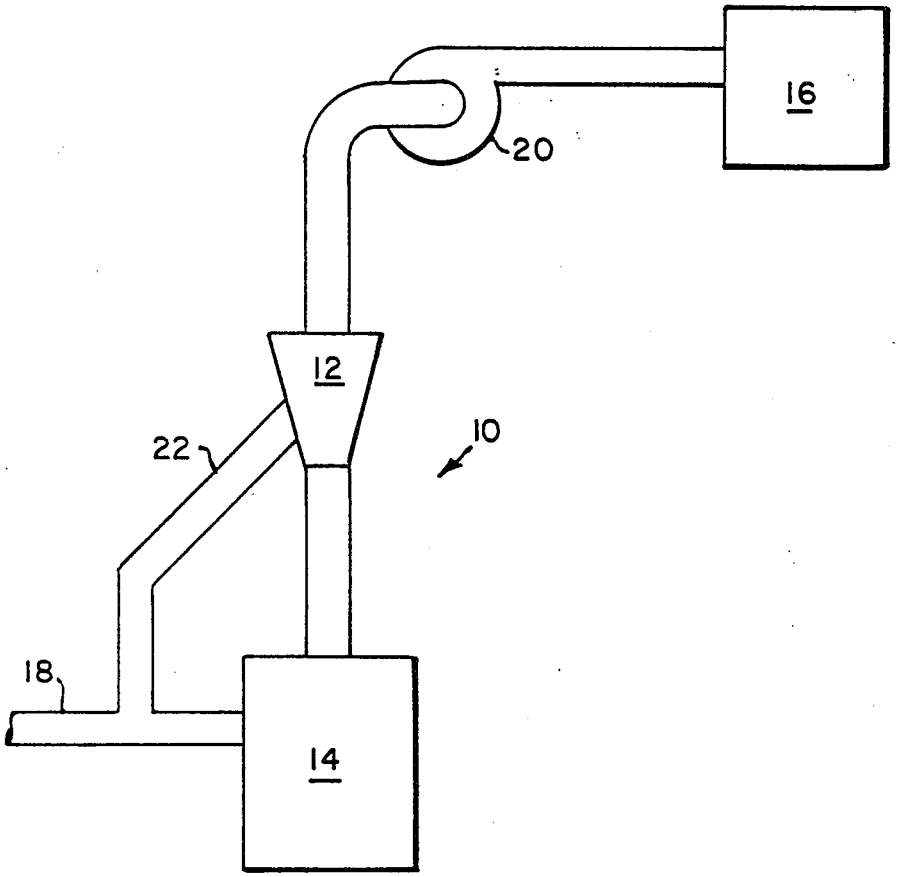
FIG. 1 is a schematic diagram of a direct fired system that embodies an external classifier means cooperatively associated with the pulverizer means, constructed in accordance with the present invention.

Referring now to the drawing, and in particular to FIG. 1 thereof, there is illustrated therein a direct fired system, generally designated by the reference numeral 10, constructed in accordance with the present invention. More specifically, there is depicted in FIG. 1 a direct fired system 10 that embodies an external classifier means, generally designated by the reference numeral 12, which is cooperatively associated in a manner to which further reference will be had hereinafter to a pulverizer means 14. In addition, both the classifier means 12 and the pulverizer means 14 are connected in fluid flow relation to a burner means that is generally designated in FIG. 1 by the reference numeral 16.

Continuing with the description of the direct fired system 10 of FIG. 1, the latter is designed to be operative for purposes of effecting the pulverization and the subsequent firing of solid fuels. To this end, the mode of operation of the direct fired system 10 of FIG. 1, simply stated, is such that solid fuel in suitable quantity is fed to the pulverizer means 14 whereat the solid fuel is ground and dried. Thereafter, the pulverized and dried solid fuel particles are caused to be conveyed to the classifier means 12 wherein the solid fuel particles are classified according to fineness, and those that are found to be oversize are rejected and returned to the pulverizer means 14 for further grinding. Those solid fuel particles though that meet the preestablished specifications for fineness are caused to be conveyed to the burner means 16 and are fired therein.

In accord with the teachings of the present invention, the pulverizer means 14 may take the form of any suitable conventional form of pulverizing device that is commonly found utilized for purposes of effecting the pulverization, i.e., grinding, of solid materials of the type that are capable of being burned as solid fuels. By way of exemplification in this regard, reference is had here to such pulverizing devices as hammermills, ring-roll mills, ball mills, etc. Since the nature of the construction as well as the mode of operation of such mills is well-known to those skilled in the art of the pulverization of materials, it is not deemed necessary to set forth a detailed description thereof herein or to include an illustration thereof in the drawing. Rather, it is deemed sufficient for purposes of obtaining an understanding of the subject matter of the present invention to simply note herein that the function of the pulverizer means 14 is to effect a pulverization and drying of solid fuel materials therewithin. For this purpose, solid fuel in the required quantity and at the required rate is supplied from a suitable source of supply thereof (not shown) to the pulverizer means 14 by any suitable form of transport means, the latter being operative to effect an interconnection of the solid fuel supply source (not shown) with the pulverizer means 14, e.g., conduit means (not shown), etc.

The drying of the solid fuel particles as well as the conveyance thereof through the pulverizer means 14 is accomplished in know fashion by means of a hot gas flow which is made to sweep through the interior of the pulverizer means 14. This hot gas, which preferably consists of air, is supplied through any suitable conventional means to the pulverizer means 14. In accord with the illustration of FIG. 1 of the drawing, the aforesaid hot gas is fed to the pulverizer means 14 through the conduit means, which is identified in FIG. 1 by the reference numeral 18.

Next as regards the classifier means 12, the latter in accord with the illustration of FIG. 1 of the drawing is positioned externally of the pulverizer means 14 but is cooperatively associated therewith. The function of the classifier means 12, as mentioned previously herein, is to effect a classification of the solid fuel particles, which after being pulverized in the pulverizer means 14 are conveyed to the classifier means 12. The latter is suitably internally constructed, preferably in a known manner, so as to be operative to effect a separation of those pulverized solid fuel particles which reach the classifier means 12 that exceed preestablished specifications for fineness.

By way of exemplification in this regard, the classifier means 12 may take the form of what is commonly referred to by those skilled in this art as a double cone classifier. Briefly described, the mode of operation of such a conventionally constructed double cone classifier is as follows. The pulverized solid fuel particles exit from the pulverizer means 14 and enter the classifier through a suitable inlet provided therein for this purpose at the bottom end thereof. These particles, which are entrained in a suitable carrier medium, e.g., air, are made to follow a first path of flow during the course of their passage through the classifier. Moreover, concomitant with the passage through the classifier of the entrained pulverized solid fuel particles a classification of the particles according to their fineness takes place. That is, in a manner which is well-known to those skilled in this art, the heavier, i.e., coarser, particles are collected and are made to follow a second path of flow before exiting from the classifier. To this end, the heavier, i.e., oversized, particles are caused to exit from the classifier through the tailings spout with which the latter is suitably provided. Meanwhile, the carrier medium, i.e., gas stream in which there remains entrained those of the pulverized solid fuel particles that are of the desired fineness continues its flow through the classifier and exits therefrom through an outlet, which is provided for this purpose at the top of the classifier. The properly sized particles, i.e., fines, are thus discharged in the form of finished product from the classifier. The gases on the other hand can be recycled through the classifier so that a continuous circulation thereof is provided through the classifier.

The third major operating component of the direct fired system 10 depicted in FIG. 1 is the burner means 16. The latter is the device in which the pulverized solid fuel particles after having been classified in the classifier means 12 and found to possess the desired fineness are fired, i.e., burned. For purposes of effecting the burning of the properly sized solid fuel particles, the burner means 16 in accord with the teachings of the present invention may comprise any form of structure which embodies a suitable type of combustion chamber. Accordingly, by way of exemplification and not limitation, the burner means 16 may take the form of any of the following: a boiler, a kiln, a furnace, or an air heater.

With further reference to FIG. 1, the pulverized solid fuel particles which in passing through the classifier means 12 have been found to possess the desired degree of fineness are preferably caused to be conveyed from the classifier means 12 to the burner means 16 through the action of the fan that is denoted in FIG. 1 by the reference numeral 20. The latter fan 20 is frequently referred to as a primary, or system, fan. For purposes of effecting the aforedescribed conveyance of the pulverized solid fuel particles from the classifier means 12 to the burner means 16, in accord with the teachings of the present invention any suitable type of fan of conventional construction which has the capability of functioning in the aforesaid manner is capable of being utilized in the direct fired system 10 of FIG. 1.

Completing the description of the structure which is schematically depicted in FIG. 1, in a manner to which further reference will be had in connection with a discussion hereinafter of each of FIGS. 3, 4, and 5, a portion of the gas flow through the classifier means 12 is recovered and returned to the pulverizer means 14. This recirculation of a portion of the gas flow from the classifier means 12 to the pulverizer means 14 is shown schematically in FIG. 1 by that structure depicted therein that is identified generally by the reference numeral 22.

Figure 2:
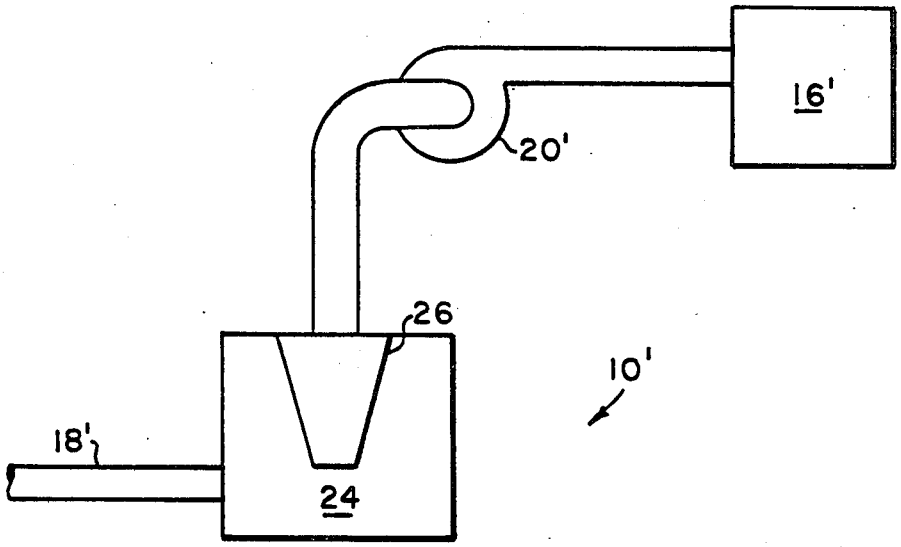
FIG. 2 is a schematic diagram of a direct fired system that embodies pulverizer means equipped with an integral classifier means, constructed in accordance with the present invention.

Turning next to a consideration of FIG. 2 of the drawing, there is schematically depicted therein a direct fired system constructed in accordance with the present invention. The principal difference between the direct fired system 10 of FIG. 1 and the direct fired system shown in FIG. 2 resides in the fact that the pulverizer means as illustrated in the latter Figure is equipped with an integral classifier means rather than being cooperatively associated with an external classifier means in the manner in which the classifier means 12 of FIG. 1 is cooperatively associated with the pulverizer means 14. Accordingly, for ease of reference and clarity of illustration those elements of structure shown in FIG. 2 that find correspondence with structure that is illustrated in FIG. 1 are denoted in FIG. 2 through the use of the same reference numerals that have been employed to identify like structure in FIG. 1 but with the addition thereto of a prime.

With further reference to FIG. 2, there is illustrated therein a direct fired system denoted generally by the reference numeral 10', which like the directed fired system 10 of FIG. 1 is operative to effect the pulverization followed by the subsequent firing of solid fuel particles. Moreover, in the manner of the direct fired system 10 of FIG. 1, solid fuel in suitable quantity and at a suitable rate is conveyed from a suitable source of supply thereof (not shown) through the conduit means 18' to the pulverizer means 24. The latter pulverizer means 24 is suitably equipped in a known fashion with an integral classifier means identified in FIG. 2 through the use of the reference numeral 26. The pulverizer means 24 equipped with the classifier means 26 is operative to effect the pulverization, drying and classifying of the solid fuel material that is conveyed thereto. Within the pulverizer means 24, the solid fuel particles after being pulverized and dried flow to the classifier means 26 whereat the oversize particles are rejected thereby and rejected thereby and are returned to the grinding chamber of the pulverizer means 24 for further grinding. As in the case of the pulverizer means 14 of FIG. 1, the drying of the solid fuel particles in the pulverizer means 24 is accomplished by having a stream of hot gases, preferably air, sweep therethrough. Not only does this stream of hot gases effect the drying of the solid fuel particles, but also it is operative to effect the conveyance of the solid fuel particles in known manner to, through, and from the grinding chamber of the pulverizer means 24 to and through the classifier means 26.

After being ground, dried and classified in the pulverizer means 24 equipped with the classifier means 26, those pulverized solid fuel particles which are of the desired fineness are caused to flow to the burner means 16'. In accord with the illustration of FIG. 2, the direct fired system 10' includes a fan 20' that is operative through the action thereof to cause the aforereferenced solid fuel particles to flow to the burner means 16'. The fan 20' that is used for this purpose is commonly referred to by those skilled in this art as a primary, or system, fan.

It is within the combustion chamber of the burner means 16' that the solid fuel particles which have been pulverized in the pulverizer means 24 and classified in the classifier means 26 are burned, i.e., fired. To this end, like the burner means 16 of FIG. 1 to which reference has been had herein previously, the burner means 16' may take many forms. In accord with the teachings of the present invention, the burner means 16' may comprise a burner, a kiln, a furnace, an air heater, etc.

For purpose of completing the description of the direct fired system 10' depicted in FIG. 2, reference is had to the fact that in accord with the teachings of the present invention, the burner means 16', the fan 20', the conduit means 18' as well as the pulverizer means 24 equipped with integral classifier means 26 preferably each embody a conventional type of construction. However, as will be discussed hereinafter in accordance with a description of the structure shown in each of FIGS. 3, 4, and 5, the classifier means 26 of FIG. 2 like the previously described classifier means 12 of FIG. 1 is suitably provided with means (not shown in FIG. 2 in the case of the classifier means 26 or in FIG. 1 in the case of the classifier means 12) operative to effect a recirculation of a portion of the hot gases that flow in the classifier means 26. More specifically, in accord with the teachings of the present invention, the path of the gas flow that takes place relative to the classifier means, be it the classifier means denoted by the reference numeral 26 of FIG. 2 or that identified in FIG. 1 by the reference numeral 12, is suitably modified such that a portion thereof is recirculated therefrom back to the corresponding pulverizer means, i.e, 24 or 14, respectively. Moreover, in accord with the best mode embodiment of the invention the portion of the gas flow that is recirculated from the classifier means 26 or 12 to the respective pulverizer means 24 or 14 is on the order of approximately fifty percent of that which would normally exit from the classifier 26, 12. The effect thereof, therefore, is that the gas flow from the classifier means 26 to the burner means 16' or from the classifier means 12 to the burner means 16 is reduced by up to approximately fifty percent whereby there is established a more desirable fuel/air ratio at the corresponding burner means 16', 16.

Figure 3:
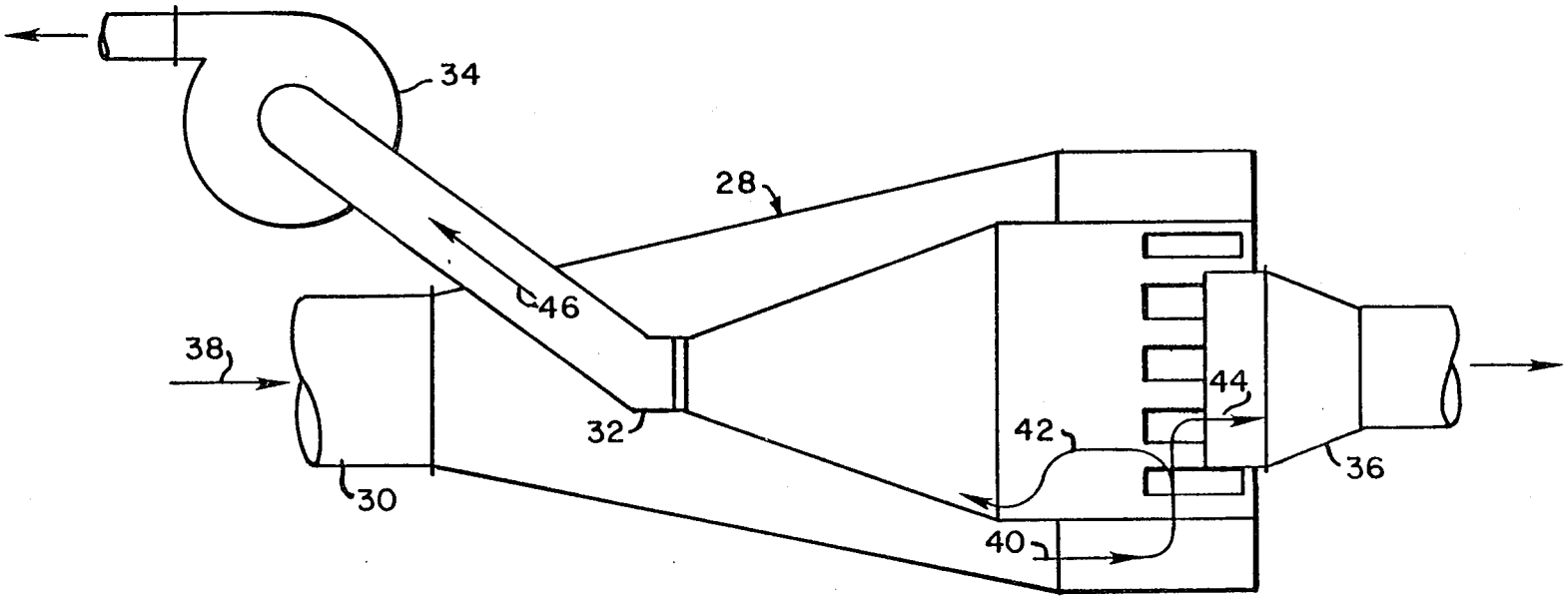
FIG. 3 is a schematic diagram on an enlarged scale of the classifier portion of one embodiment of a direct fired system constructed in accordance with the present invention.
Figure 4:
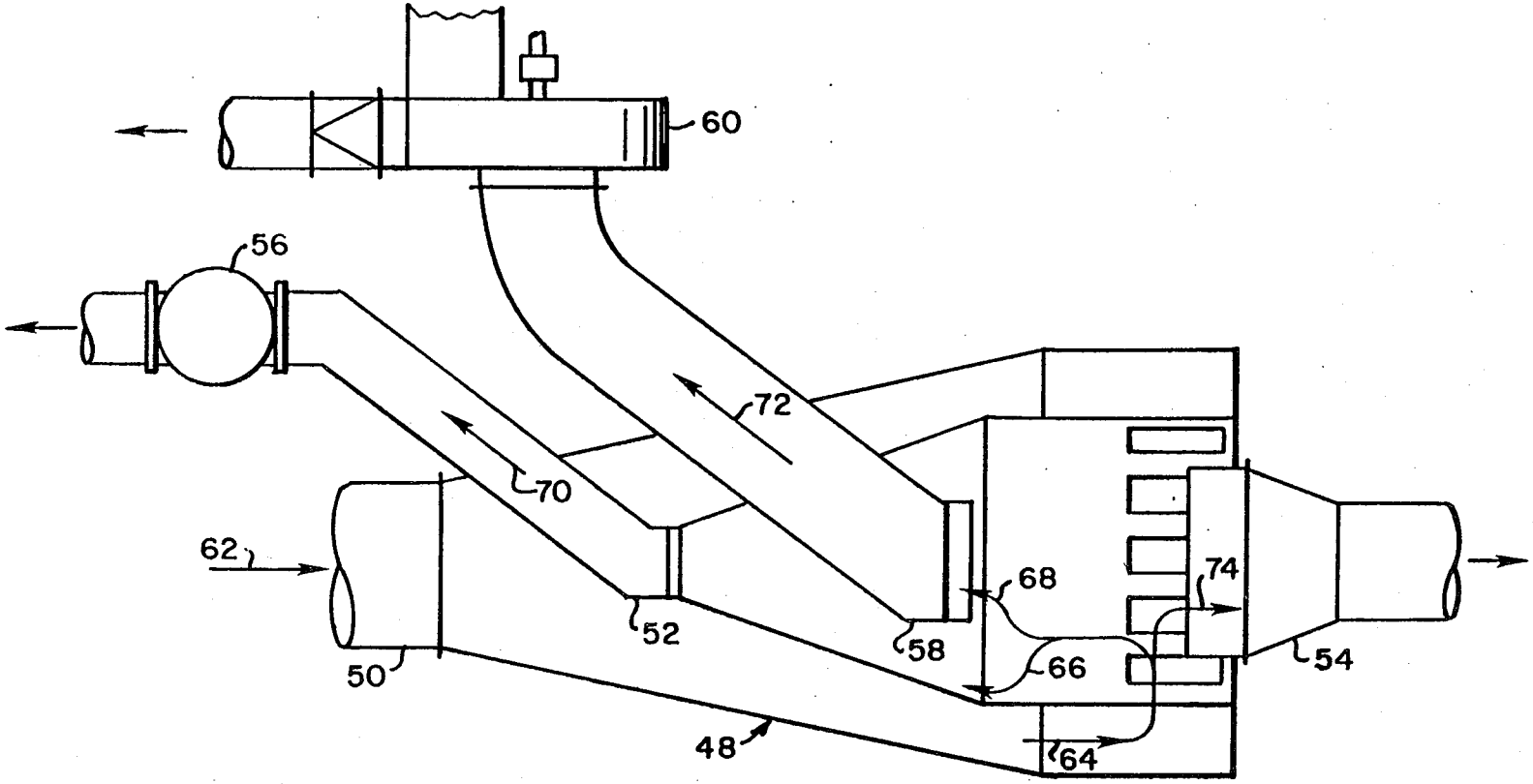
FIG. 4 is a schematic diagram on an enlarged scale of the classifier portion of a second embodiment of a direct fired system constructed in accordance with the present invention.
Figure 5:
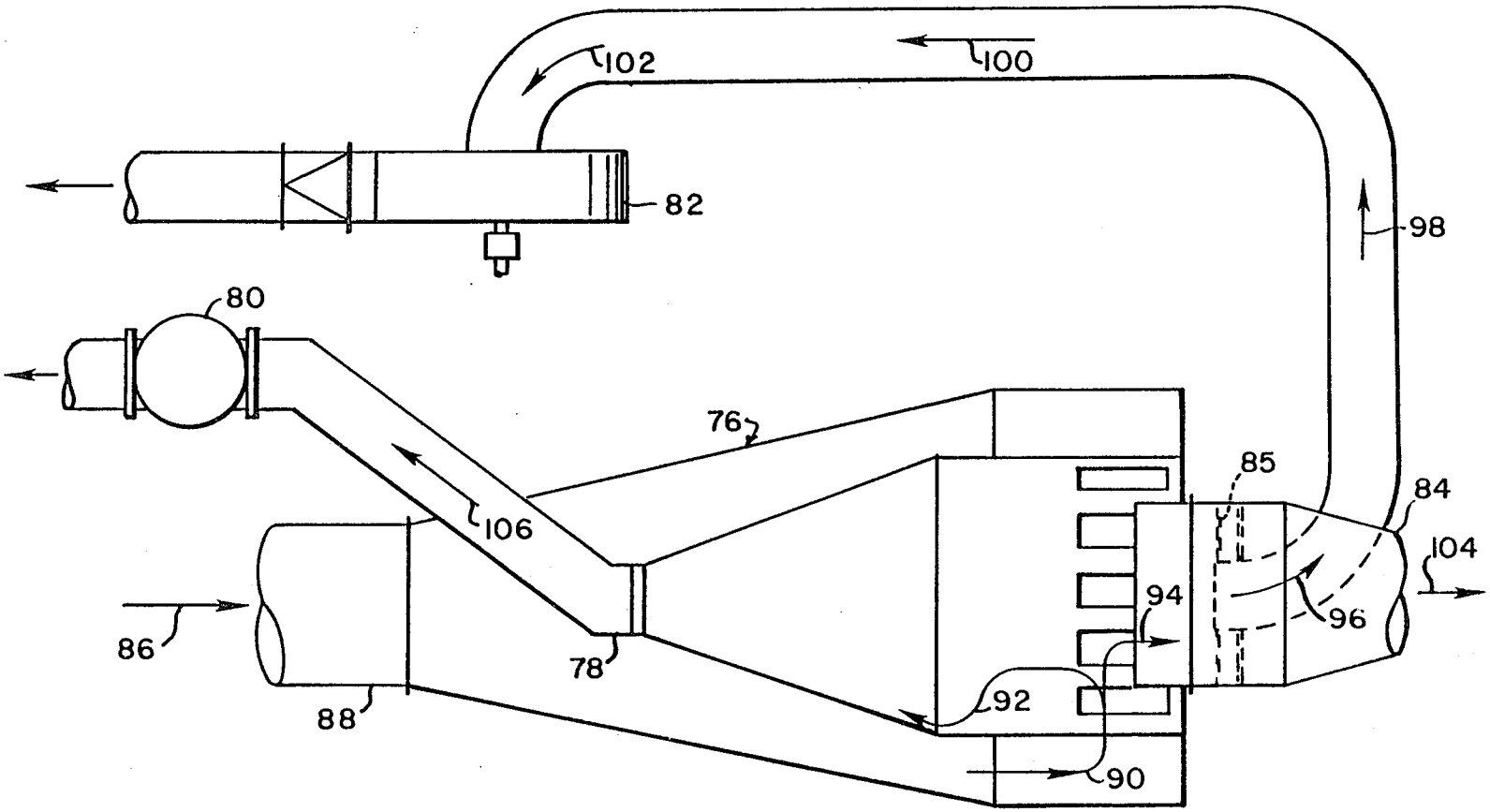
FIG. 5 is a schematic diagram on an enlarged scale of the classifier portion of a third embodiment of a direct fired system constructed in accordance with the present invention.

For the purpose of the description that follows of the structure shown in each of FIGS. 3, 4 and 5, reference will be had to an external classifier means that is cooperatively associated with a pulverizer means as contrasted to an integral classifier means with which a pulverizer means may be equipped. However, it is to be understood that insofar as the subject matter of the present invention is concerned, the classifier means shown in each of FIGS. 3, 4 and 5 could equally well, without departing from the essence of the present invention, be in form of a classifier means that is integral with a pulverizer means. Moreover, it is to be understood that for purpose of understanding the subject matter of the present invention the discussion that follows hereinafter is equally applicable to either type of classifier means, i.e., and external classifier means such as that denoted by the reference numeral 12 in FIG. 1, or an integral classifier means such as that designated by the reference numeral 26 in FIG. 2. Finally, it is to be assumed for purpose of the discussion which follows that the classifier means which is depicted in each of FIGS. 3, 4 and 5 is constructed in the manner of a double cone classifier.

Thus, turning first to a consideration of FIG. 3 of the drawing, there is depicted therein a classifier means, generally, designated by the reference numeral 28. The classifier means 28 in known fashion is operative to classify the solid fuel particles that are recieved thereby after having been pulverized in a pulverizer means. More specifically, the classifier means 28 is operative to effect a rejection of those particles that are oversize, i.e., exceed preset specifications for fineness with which the classifier means 28 is provided. To this end, the pulverized solid fuel particles, flow from the pulverizer means (not shown), e.g., the pulverizer means denoted by the reference numeral 14 in FIG. 1, entrained in a stream of hot gases, which in accord with the preferred embodiment of the invention comprises air. For this purpose, the classifier means 28 is suitably interconnected in fluid flow relation with the aforesaid pulverizer means (not shown) by means of conduit means 30 which embodies a conventional form of construction. After entering the classifier means 28 from the conduit means 30, those solid fuel particles which do not meet the preset specifications for fineness are rejected, i.e., separated from the stream of air in which they are entrained. This separation of the oversize particles is effected within the classifier means 28 in known fashion, either centrifugally or by means of inertia.

Continuing, the oversize particles are then returned for further grinding to the grinding chamber of the pulverizer means (not shown) through a tailings spout, identified by the reference numeral 32 in FIG. 3, with which the classifier means 28 is suitably provided. In accord with the teachings of the present invention, however, the tailings discharge valve with which a conventionally constructed double cone classifier of the type that is suitable for use in cooperative association with a pulverizer means in a prior art form of firing system is replaced by a material handling fan, the latter being generally designated in FIG. 3 by the reference numeral 34. The latter material handling fan 34 is suitably connected in fluid flow relation with the tailings spout 32 of the classifier means 28 such that through the action thereof the oversize particles thereof, i.e., tailings, that do not meet the preset specification for fineness of the classifier means 28 are caused to return, i.e., flow back, to the grinding chamber of the pulverizer means (not shown) for further grinding therewithin. In addition, however, and most importantly from the standpoint of the novelty of the present invention, the material handling fan 34 is also intended to be operative such that a portion of the stream of air that flows through the classifier means 28 is also made to return to the pulverizer means (not shown). Namely, the material handling fan 34 functions not only to cause the oversize particles that are discharged from the classifier means 28 through the tailings spout 32 to be returned back to the pulverizer means (not shown) for further grinding therein, but also functions to return with the oversize particles up to fifty percent of the air that would normally flow from the classifier means 28 to the burner means (not shown) with which the classifier means 28 is cooperatively associated, i.e., in the manner of the burner means 16 with which the external classifier means 12 of FIG. 1 is suitably cooperatively associated.

The effect of this recirculation of a portion of the air flow through the action of the material handling fan 34 from the classifier means 28 to the pulverizer means (not shown) is to reduce the amount of air that leaves the classifier means 28 through the conduit means that is denoted in FIG. 3 by means of the reference numeral 36. Although not shown in FIG. 3 in the interest of maintaining clarity of illustration therein, it is to be understood that the conduit means 36 is suitably connected in fluid flow relation with a primary, i.e., system, fan (not shown) and therethrough to a suitable burner means (not shown), the latter being designed to be operative to effect a burning, i.e., firing, therewithin of the solid fuel particles that have been determined through the operation of the classifier means 28 to possess the desired degree of fineness.

By way of exemplification and not limitation, if the amount of air flow in which solid fuel particles are entrained from the pulverizer means (not shown) is on the order of forty thousand cubic feet per minute (CFM), then the material handling fan 34 is designed to effect a recirculation from the classifier means 28 to the pulverizer means (not shown) of up to twenty thousand CFM. The other twenty thousand CFM of air flow which enters the classifier means 28 through the conduit means 30 flows from the classifier means 28 through the conduit means 36 to the burner means (not shown) along with those solid fuel particles which are of the desired size, i.e., the fines.

The aforedescribed path which the air flow follows relative to the classifier means 28 is schematically depicted in FIG. 3 through the use of a series of arrows. More specifically, the arrow identified by the reference numeral 38 in FIG. 3 is intended to depict the air flow that enters the classifier means 28 from the conduit means 30 and in which the pulverized solid fuel particles that are to be classified within the classifier means 28 are entrained. Similarly, the arrow 40 identifies the same air flow before the latter is split essentially in half, with fifty percent thereof, i.e., that represented by the arrow 42 flowing into the tailings spout 32, and the other fifty percent, i.e., that identified by the arrow 44, exiting from the classifier means 28 through the conduit means 36. Finally, the arrow 46 is intended to depict the up to fifty percent of air flow that is caused to be circulated from the classifier means 28 to the pulverizer means (not shown).

Next with regard to FIG. 4 of the drawing, a second embodiment of classifier means, generally designated by the reference numeral 48 and constructed in accord with the present invention, is depicted therein. Like the classifier means 28 of FIG. 3 and as has been mentioned herein previously, the classifier means 48 of FIG. 4 for purposes of the discussion thereof that follows is deemed to be an external classifier means of the double cone type embodying a form of construction and having a mode of operation like that described above in connection with the discussion of the classifier means 28 of FIG. 3. The function of the classifier means 48 is to effect a separation from the gas stream in which the pulverized solid fuel particles are entrained of those particles that are oversize, i.e., exceed the specifications for fineness with which the classifier means 48 has been preset. To this end, the classifier means 48 is provided at one end thereof with conduit means 50 suitably interconnected thereto through which the stream of hot gases, the latter preferably comprising air, in which the solid fuel particles pulverized in a pulverizer means (not shown), such as the pulverizer means 14 of FIG. 1, are entrained, flow from the pulverizer means (not shown) to the classifier means 48. After entering the classifier means 48, the latter in known fashion functions to cause the oversize pulverized solid fuel particles to flow into the tailings spout 52 whereas those solid fuel particles that are of the desired fineness exit from the classifier means 48 through the conduit means 54. The latter conduit means 54 serves to suitably interconnect the classifier means 48 with burner means (not show), such as the burner means 16 of FIG. 1, in which the properly sized pulverized solid fuel particles are fired, i.e., burned.

Continuing, in accord with the illustration of the structure that is depicted in FIG. 4, the classifier means 48 includes a tailings discharge valve means, generally designated by the reference numeral 56. The latter valve means 56 is suitably positioned at the downstream end of the tailings spout 52 such that control can be effected through the operation thereof over the discharge of oversize particles from the tailings spout 52 for return to the pulverizer means (not shown) whereat the oversize particles are subjected to further grinding. In addition to the fact that the tailings discharge valve means 56 is retained thereby, the classifier means 48 in accord with the teachings of the present invention is also provided with a receiver hood, generally designated by the reference numeral 58, and a dust handling fan 60. The receiver hood 58 preferably is located at the center of the cone portion of the classifier means 48 so as to be in a position to receive therein up to approximately fifty percent of the gas flow, i.e., air, that enters the classifier means 48 through the conduit means 50. Moreover, the air received by the receiver hood 58 is recycled back to the pulverizer means (not shown) through the action of the dust handling fan denoted by the reference numeral 60 in FIG. 4. In summary, therefore, the mode of operation of the classifier portion of a direct fired system constructed in accordance with the present invention and as depicted in FIG. 4 is such that the oversize particles upon being rejected in the classifier means 48 are made to flow into the tailings spout 52 from whence they are discharged by operation of the tailings discharge valve means 56 for return to the pulverizer means (not shown) whereupon they are subjected to further grinding. Whereas, the path of air flow through the classifier means 48 is such that fifty percent of the air that enters the classifier means 48 is made to enter the receiver hood 58 so as to be recycled back to the pulverizer means (not shown) by operation of the dust handling fan 60, while the remaining fifty percent of the air that entered the classifier means 48 is made to exit from the latter through the conduit means 54 along with those pulverized solid fuel particles that are of the desired size and to flow onto the burner means (not shown) whereat the latter particles are fired. It can thus be seen from the above that in accord with the teachings of the subject matter of the present invention and as exemplified by the structure that is shown in FIG. 4, a reduced flow of air is provided from the classifier means 48 to the burner means (not shown) which in turn results in the establishment of a more desirable fuel/air ratio in the burner means (not shown).

The aforedescribed flow path of the air through the classifier means 48 is best understood with reference to the series of arrows that appear in FIG. 4. Thus, with reference to FIG. 4, the arrow denoted by the reference numeral 62 indicates the air flow entering the classifier means 48 through the conduit means 50. It is to be understood that there is entrained in the air flow depicted by the arrow 62 the solid fuel particles that have undergone pulverization in the pulverizer means (not shown). This mixture of air and entrained pulverized solid fuel particles is further represented by the arrow 64 before the oversize particles are separated therefrom and a portion of the air flow is removed therefrom. Arrow 66 is intended to depict the oversize particles which after rejection are made to flow into the tailings spout 52, whereas arrow 68 depicts the up to fifty percent of the air flow that is captured by the receiver hood 58 for subsequent recycling to the pulverizer means (not shown). The passage of the oversize particles through the tailings spout 52 to the tailings discharge valve means 56 is indicated by the arrow 70, while the passage of the air flow captured by the receiver hood 58 therefrom to the dust handling fan 60 is indicated by the arrow 72. Lastly, the remaining fifty percent of the air flow in which the properly sized pulverized solid fuel particles are entrained exits from the classifier means 48 through the conduit means 54 as indicated by the arrow denoted in FIG. 4 by the reference numeral 74.

Turning now to a consideration of the final Figure, i.e., FIG. 5, of the drawing, there is illustrated therein a third embodiment of classifier means, generally designated by the reference numeral 76, constructed in accordance with the teachings of the present invention for employment in a direct fired system as shown at 10 in FIG. 1, or at 10' in FIG. 2. Like the classifier means 28 of FIG. 3 and the classifier means 48 of FIG. 4, the classifier means 76 of FIG. 5 is intended to be an illustration of an external classifier of the double cone type which is suitably cooperatively associated with a pulverizer means (not shown). To this end, the function of the classifier means 76 is to effect the rejection of the pulverized solid fuel particles received thereby from the pulverizer means (not shown) which do not meet preset specifications for fineness. The structure which the classifier means 76 embodies that enables it to effect the aforedescribed rejection of oversize particles as well as the mode of operation thereof whereby the rejection is accomplished is the same as that of the classifier means 28 and 48 to which reference has been had previously hereinbefore. Thus, it is not deemed necessary for purposes of understanding the subject matter of the present invention to provide at this point by way of reiteration a description of the structure and mode of operation of the classifier means 76. Suffice it to say that after rejection the oversize particles are caused to flow into the tailings spout 78 with which the classifier means 76 is suitably provided. The discharge of the oversize particles from the tailings spout 78 is effected by operation of a tailings discharge valve means, generally designated by the reference numeral 80 in FIG. 5. After being discharged in the aforedescribed manner, the oversize particles are suitably conveyed back to the pulverizer means (not shown) whereat a further grinding thereof takes place.

Referring further to FIG. 5, in accord with a third embodiment of the subject matter of invention, the classifier means 76 is suitably provided with a dust handling fan, denoted generally by the reference numeral 82 in FIG. 5. More specifically, the dust handling fan 82 is suitably positioned so as to be connected in fluid flow relation with the outlet portion of the classifier means 76 whereby the dust handling fan 82 is operative to remove from the air flow reaching the outlet portion of the classifier means 76 up to fifty percent of the air flow for recirculation to the pulverizer means (not shown). The remaining portion, i.e., fifty percent, of the air flow that arrives at the outlet portion of the classifier means 76 exits therefrom along with the solid fuel particles that are of the desired fineness, which are entrained therein, through the conduit means 84. The latter conduit means 84 is suitably connected in fluid flow relation with a burner means (not shown) such as the burner means 16 of FIG. 1 in which the properly sized solid fuel particles are intended to be fired. Although not illustrated in FIG. 5 in the interest of maintaining clarity of illustration therein, a primary, or system, fan of conventional construction may be employed for purposes of effecting the conveyance of the mixture of air and properly sized solid fuel particles from the classifier means 76 to the burner means (not shown).

The path of the air flow through the classifier means 76 is believed to be best understood with reference to the series of arrows that appear in FIG. 5. Thus, the arrow denoted by the reference numeral 86 is intended to be representative of the air flow in which the solid fuel particles that have been pulverized in the pulverizer means (not shown) are entrained which enters the classifier means 76 through the conduit means designated by the reference numeral 88. This mixture of air and pulverized solid fuel particles is further identified in FIG. 5 by means of the arrow 90. Thereafter, the oversize particles are separated from the aforesaid mixture and are caused to flow into the tailings spout 78 as illustrated in FIG. 5 by means of the arrow 92. Upon removal therefrom of the oversize particles, i.e., those that do not meet the specifications for fineness with which the classifier means 76 has been preset, the air still entrained with those particles that have the desired fineness flows as illustrated by the arrow 94 in FIG. 5 to the outlet portion of the classifier means 76. However, prior to entering the conduit means 84 up to fifty percent of the air in the air flow that arrives at the outlet portion is removed therefrom and this air as denoted by the series of arrows 96, 98, 100 and 102 is caused to be recycled by operation of the dust handling fan 82 to the pulverizer means (not shown). In accord with the mode of operation of the classifier means 76, constructed as depicted in FIG. 5, the particles preparatory to their passage into the conduit means 84 are subjected to a further classifying action. To this end, a vane means, generally designed by the reference numeral 85 in FIG. 5, is interposed in mounted relation to the path of flow of the particles as they enter the conduit means 84. More specifically, the vane means 85 preferably includes a set of swirling vanes and a set of stationary vanes that coact in such a manner as to effect a further classifying of the particles by causing the latter under the influence of centrifugal force to move outwardly into juxaposed relation to the inner surface of the structure that comprises the conduit means 84. Thereafter, the remaining portion of the air flow in which the properly sized pulverized solid fuel particles are entrained passes into the conduit means 84 and as indicated by means of the arrow 104 is conveyed from the classifier means 76 to the burner means (not shown) whereat the particles are fired. Finally, the passage of the oversize particles through the tailings spout 78 is depicted in FIG. 5 through the use of the arrow 106.

As set forth hereinbefore in accord with the teachings of the present invention a portion of the hot gas flow, i.e., air, through the classifier means is made to recirculate back to the pulverizer means. This recirculation of up to fifty percent of the air flow through the classifier means may be accomplished in several ways. Thus, in accord with a first embodiment of the invention, which can be found illustrated in FIG. 3, the recycled air along with the oversize particles is fed from the classifier means 28 to the pulverizer means (not shown) by operation of the material handling fan 34. In contrast thereto, in accord with a second embodiment of the invention, which is FIG. 4, the recycled air is captured by a receiver hood 58 and is made to flow from the classifier means 48 to the pulverizer means (not shown) under the influence of the dust handling fan 60. Lastly, in accord with a third embodiment of the invention, the latter being depicted in FIG. 5 of the drawings, the recycled air is removed at the outlet of the classifier means 76 and is recirculated to the pulverizer means (not shown) by operation of the dust handling fan 82. The effect of the aforereferenced recirculation of a portion of the air flow that passes through the classifier means to pulverizer means is to reduce the amount of air that flows from the classifier means to the burner means and thus in turn reduce the fuel/air ratio that is established at the burner means for purposes of accomplishing therewithin the burning, i.e., firing, of the pulverized solid fuel particles that are conveyed thereto for this purpose. In summary, therefore, by virtue of the aforereferenced recirculation of a portion of the air flow from the classifier means to the pulverizer means an improvement is realized in the thermal efficiency of the direct fired system of which the classifier means forms an operating component. Moreover, this improvement in the system efficiency of the direct fired system is achieved while at the same time there is retained all of the desirable advantages in terms of simplicity, low cost and safety that a direct-fired system possesses.

The continued escalation of fuel prices gives increased significance to the achievement of the aforementioned improvement in the thermal efficiencies of a fired system that yet retains the advantages of a direct-fired system. Namely, as a consequence of the escalation of fuel prices, the consumption of poorer grades of coal along with other biomass fuels is increasing. These latter solid fuels have low grindability so that for any given size pulverizer, the capability therewith to effect pulverization of these fuels is significantly reduced. Moreover, since the air flow through the pulverizer required for the operation thereof normally can not be reduced in proportion to reductions in capacity, the fuel/air ratio is very low through the pulverizer in the case of a direct-fired system. However, in accord with the teachings of the present invention a direct fired system is provided with which it is possible to maintain a high fuel to air ratio insofar as the pulverizer is concerned, i.e., as necessitated thereby when fuels of poor grindability are being pulverized therewith, while still maintaining the advantageous features of a direct-fired system.

To summarize, in accordance with the present invention there has been provided a new and improved form of firing system of the type that is operative for purposes of effecting the pulverization of solid fuels followed by the firing thereof. Moreover, the subject firing system of the present invention is in the nature of a direct fired system. In addition, in accord with the present invention a direct fired system is provided which possesses the advantages of a direct-fired system insofar as simplicity, low cost and safety are concerned. Further, the subject direct fired system of the present invention is also advantageously characterized by the fact that in accord with the mode of operation thereof a more desirable fuel/air ratio is established at the burner. Additionally, in accord with the present invention a direct fired system is provided wherein the establishment of a more desirable fuel/air ratio at the burner is accomplished as a consequence of causing the recirculation back to the pulverizer of a portion of the gases that flow through the classifier.

While several embodiments of our invention have been shown, it will be appreciated that modifications thereof, some of which have been alluded to hereinabove, may still be readily made thereto by those skilled in the art. We, therefore, intend by the appended claims to cover the modifications alluded to herein as well as all other modifications, which fall within the true spirit and scope of our invention.

We claim:

1. In a direct fired system operative for purposes of effecting the pulverization and subsequent firing of solid fuels, said direct fired system including pulverizer means for pulverizing solid fuel material, classifier means for rejecting pulverized solid fuel particles that exceed preset specifications for fineness and for returning the rejected oversize particles to the pulverizer means for further pulverization, burner means for firing therewithin properly sized solid fuel particles, and means establishing a fluid flow path for a stream of hot gases and for the pulverized solid fuel particles from the pulverizer means to the classifier means and from the classifier means to the burner means, the improvement comprising classifier means consisting of a double cone classifier including a tailings spout, recirculation means connected at one end in fluid flow relation to said tailings spout and connected at the other end to the pulverizer means, said recirculation means including a material handling fan supported in mounted relation along the length of said recirculation means intermediate the ends thereof, said material handling fan being operative to recirculate from said tailings spout directly back to the pulverizer means a portion of the stream of hot gases that enters said double cone classifier and that upon exiting from said tailings spout of said double cone classifier has entrained therein the rejected oversize particles, said material handling fan thereby effectuating the return of the rejected oversize particles to the pulverizer means for further pulverization therewithin while concomitantly preventing the circulation from said double cone classifier to the burner means of the entire stream of hot gases that enters said double cone classifier so as to improve the combustion ratio of solid fuel particles to hot gases at the burner means.

2. In a direct fired system as set forth in claim 1 wherein said material handling fan effects the recirculation back up to the pulverizer means from said tailings spout of up to fifty percent of the stream of hot gases that enters said double cone classifier.

* * * * *